US009139408B2

(12) United States Patent
Alveteg

(10) Patent No.: US 9,139,408 B2
(45) Date of Patent: Sep. 22, 2015

(54) INDUSTRIAL TRUCK, METHOD AND COMPUTER PROGRAM FOR CONTROLLING AN INDUSTRIAL TRUCK

(75) Inventor: Magnus Alveteg, Borensberg (SE)

(73) Assignee: BT PRODUCTS AB, Mjolby (SE)

( * ) Notice: Subject to any disclaimer, the term of this patent is extended or adjusted under 35 U.S.C. 154(b) by 899 days.

(21) Appl. No.: 13/275,133

(22) Filed: Oct. 17, 2011

(65) Prior Publication Data

US 2012/0107077 A1 May 3, 2012

(30) Foreign Application Priority Data

Nov. 1, 2010 (EP) ..... 10189580

(51) Int. Cl.

| | |
|---|---|
| ***B66F 17/00*** | (2006.01) |
| ***B66F 9/24*** | (2006.01) |
| ***B66F 9/20*** | (2006.01) |
| ***B66F 9/075*** | (2006.01) |

(52) U.S. Cl.

CPC ..... *B66F 9/24* (2013.01); *B66F 9/0755* (2013.01); *B66F 9/20* (2013.01); *B66F 17/003* (2013.01)

(58) Field of Classification Search

CPC ..... B66F 17/003; B66F 9/22; B66F 9/24; B66F 9/0755; B66F 9/122; B66F 9/12; B66F 9/14; B66F 9/18; B66F 9/10; B66F 9/148; B66F 9/143; B66F 9/20; B66F 9/06; B66F 3/22; B66F 9/02; B66F 9/08; B66F 9/07545; B25J 13/082; E02F 9/2025; E02F 9/26; A01B 79/005; G05B 5/01; G05B 19/075; G05B 13/048; G05B 11/42; G05B 13/042; G05B 15/02; G05B 19/0423; G05B 19/042; B01D 53/8631; G01B 21/047; G08G 1/0104; H01L 21/681; H01L 21/67259; H01L 21/67276; G11B 17/225; G01P 3/489; B60K 31/0008; B29C 59/12; G07F 19/20; G07F 19/201; F04D 27/004

USPC ..... 414/636, 664, 667, 671; 701/50; 700/46, 66, 218, 304; 187/224, 233, 187/287

See application file for complete search history.

(56) References Cited

U.S. PATENT DOCUMENTS

| | | | | |
|---|---|---|---|---|
| 2,790,513 | A * | 4/1957 | Draxler | 187/224 |
| 3,708,077 | A * | 1/1973 | Richens et al. | 414/279 |

(Continued)

FOREIGN PATENT DOCUMENTS

| | | |
|---|---|---|
| EP | 0795514 A1 | 9/1997 |
| EP | 1203743 A1 | 5/2002 |
| EP | 1203745 A1 | 5/2002 |

OTHER PUBLICATIONS

European Search Report, Apr. 6, 2011.

*Primary Examiner* — Saul Rodriguez
*Assistant Examiner* — Glenn Myers
(74) *Attorney, Agent, or Firm* — Quarles & Brady LLP

(57) ABSTRACT

The invention relates to an industrial truck (10; 15) comprising a truck body (20) and a load supporting member (30). The load supporting member (30) is movable in a vertical direction (40) and in a horizontal direction (50; 80) in relation to the truck body (20). According to the invention, the industrial truck (10; 15) is adapted to reduce the maximum allowed acceleration of the load supporting member (30) in the vertical direction (40) when the load supporting member is located at specific horizontal positions in relation to the truck body (20). The invention also pertains to a corresponding method and a computer program.

14 Claims, 3 Drawing Sheets

(56) References Cited

U.S. PATENT DOCUMENTS

| | | | | | |
|---|---|---|---|---|---|
| 4,218,170 | A * | 8/1980 | Goodacre | 414/666 |
| 4,252,217 | A * | 2/1981 | Benjamin | 414/592 |
| 4,286,911 | A * | 9/1981 | Benjamin | 414/273 |
| 4,470,750 | A * | 9/1984 | Vockinger | 414/666 |
| 4,942,529 | A * | 7/1990 | Avitan et al. | 701/50 |
| 5,091,685 | A | 2/1992 | Sorenson | |
| 5,170,863 | A * | 12/1992 | Devroy | 187/224 |
| 5,798,920 | A * | 8/1998 | Crucius et al. | 700/66 |
| 5,838,572 | A * | 11/1998 | Hofstetter et al. | 700/213 |
| 6,425,728 | B1 * | 7/2002 | Goto | 414/636 |
| 6,945,745 | B2 * | 9/2005 | Retzlaff | 414/636 |
| 7,533,763 | B2 * | 5/2009 | Kattainen et al. | 187/394 |
| 7,631,730 | B2 * | 12/2009 | Anasis et al. | 187/296 |
| 7,865,286 | B1 * | 1/2011 | Hall | 701/50 |
| 8,306,703 | B1 * | 11/2012 | Saleh | 701/49 |
| 8,657,074 | B2 * | 2/2014 | Bonanno et al. | 187/293 |
| 2004/0154871 | A1 * | 8/2004 | Allerding et al. | 187/287 |
| 2004/0159499 | A1 * | 8/2004 | Allerding et al. | 187/287 |
| 2006/0104783 | A1 * | 5/2006 | Schroder | 414/667 |
| 2010/0274409 | A1 * | 10/2010 | Smith et al. | 700/304 |

* cited by examiner

INDUSTRIAL TRUCK, METHOD AND COMPUTER PROGRAM FOR CONTROLLING AN INDUSTRIAL TRUCK

CROSS-REFERENCE TO RELATED APPLICATIONS

The present application claims the benefit of European Patent Application No. 10189580.3 filed Nov. 1, 2010, which is fully incorporated herein by reference.

TECHNICAL FIELD

The present invention assigns to industrial trucks with horizontally movable load supporting members.

BACKGROUND ART

In the area of industrial trucks, which often handle heavy loads, truck stability is a vital issue. Poor truck stability, especially when goods are handled at relatively high lift heights, may lead to damages due to dropped goods and also incurs increased truck wear.

Document EP1203745 A1 describes an industrial lift truck having a truck body and a load supporting member that is movable in a vertical direction and in a horizontal direction in relation to the truck body. The truck is adapted to reduce the maximum allowed acceleration of the load supporting member in the horizontal direction when the load supporting member carries heavy load and is located at high vertical positions in relation to the truck body, as is described in EP1203745 A1 with reference to FIG. 2 therein.

The object of the present invention is to reduce damages caused by industrial trucks and to improve the useful life of industrial trucks.

SUMMARY OF THE INVENTION

The object of the present invention is solved by providing an industrial truck comprising a truck body and a load supporting member that is movable in a vertical and a horizontal direction. The truck is adapted to reduce the maximum allowed acceleration of the load supporting member in the vertical direction when the load supporting member is located at specific horizontal positions in relation to the truck body.

The present invention solves the problems posed by reducing the maximum allowed vertical acceleration of the load supporting member. The invention is based on the understanding that said vertical acceleration affects the mass equilibrium equation of the truck in three ways:

1) the vertical acceleration of the load supporting member and the load carried thereby,
2) the horizontal acceleration (originating from the fact that the truck mast deflects due to the vertical acceleration) of the load supporting member and the load carried thereby, and
3) the increased lever (again originating from the mast deflection) of the load supporting member and the load carried thereby.

Unfortunately, the maximum values of 2) and 3) coincide; the horizontal acceleration reaches a top value when the load supporting member turns in its slewing horizontal motion, at this turning point the lever is also the largest. Since these effects are increased when the load supporting member is located at specific horizontal positions in relation to the truck body, the invention proposes reducing the vertical acceleration of the load supporting member when located at such horizontal positions.

Said decrease of the vertical acceleration improves truck stability and reduces mast stress. The invention also provides easier operation of the truck, since an operator need not consider the current horizontal position of the load supporting member and on occasion, i.e. at specific horizontal positions, make an effort to move the load gently in the vertical direction.

The load supporting member may be movable between an innermost horizontal position and an outermost horizontal position. The innermost horizontal position corresponds to the load supporting member being located closest to the centre of gravity of the truck body, and the outermost horizontal position corresponds to the load supporting member being located furthest away from the centre of gravity of the truck body. In this connection, the truck may be adapted to reduce said vertical acceleration when the load supporting member is located a distance away from said innermost horizontal position. During normal operation, most of the material handling is performed with the load supporting member located at the innermost position, i.e. closest to the truck body. The load supporting member is normally only displaced away from the truck body when load is picked up or delivered. Thus, by reducing the vertical acceleration when the load supporting member is located a distance away from the innermost horizontal position, most of the material handling can be carried out efficiently at normal vertical acceleration, and the vertical acceleration is only reduced when appropriate.

As a matter of fact, the described stability issue is aggravated with increasing distance of the load supporting member away from the truck body. The acceleration may therefore be reduced gradually depending on the load supporting members' prevailing distance away from said innermost horizontal position, e.g. in a stepless manner.

The industrial truck may comprise position sensing means adapted to sense the horizontal position of the load supporting member in relation to the truck body. Such position sensing means may be arranged to be triggered when the load supporting member is located at the innermost horizontal position. Since the truck may then be adapted to reduce the vertical acceleration only when the load supporting member is located at the innermost horizontal position, this corresponds to a simple realization of the invention. The position sensing means emits a signal which is received by control means of the truck, e.g. a truck computer, which is adapted to control the vertical acceleration of the load supporting member. In this text, the expression triggered means either activated or deactivated.

According to a particularly simple solution, the position sensing means is a spring-back mechanical switch that is arranged to be triggered by the load supporting member. The mechanical switch may for instance be a push button or toggle switch that is arranged between the truck body and the load supporting member, it may be arranged to be contacted by a surface of the load supporting member. However, the position sensing means may alternatively be a contact-free proximity sensor.

By reducing not only the maximum allowed vertical acceleration of the load supporting member, but also the maximum allowed vertical speed, it can be ensured that the vertical movement of the load supporting member can be quickly stopped at any time. Attempts have shown that suitable reduction of the maximum allowed speed lies in the range of 60-90%, a preferred range being 70-80%.

The object of the present invention is also solved by a method for controlling an industrial truck comprising a truck body and a load supporting member, wherein the load supporting member is movable in a vertical direction and a horizontal direction in relation to the truck body. The method includes the step of reducing the maximum allowed acceleration of the load supporting member in the vertical direction when the load supporting member is located at specific horizontal positions in relation to the truck body. All advantages described above apply also to this method. The method may also include the step of reducing the maximum allowed speed in the vertical direction. On industrial trucks comprising a computer, the object may also be solved by a computer program which, when executed by a processor means of the industrial truck, causes said industrial truck to perform said method. Thereby, when applicable, the invention may easily be implemented by updating the software of existing trucks, without any structural redesign.

BRIEF DESCRIPTION OF THE DRAWINGS

An embodiment of the present invention is described below with reference to the enclosed drawings, in which.

DETAILED DESCRIPTION

Figure 1:
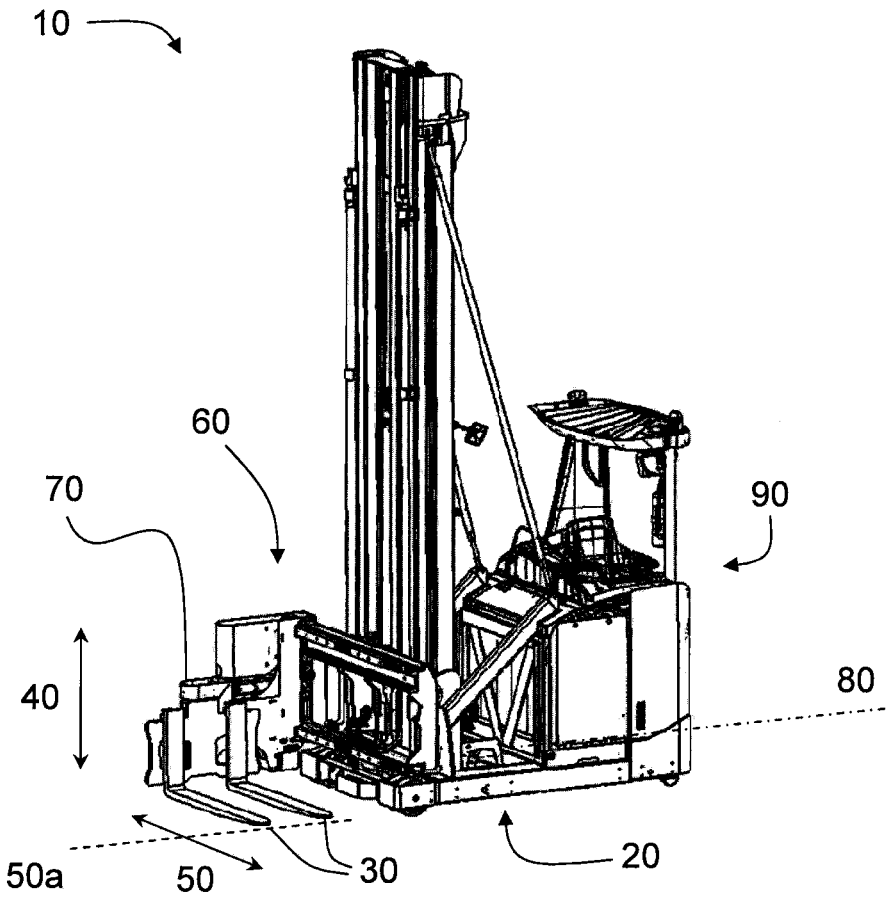
FIG. 1 shows an industrial lift truck in the form of a narrow aisle forklift truck.

The present invention is applicable on industrial lift trucks in general. Examples of industrial lift trucks are given in FIGS. 1-4. The same reference numerals apply to equivalent components or components having corresponding functions.

Figure 2:
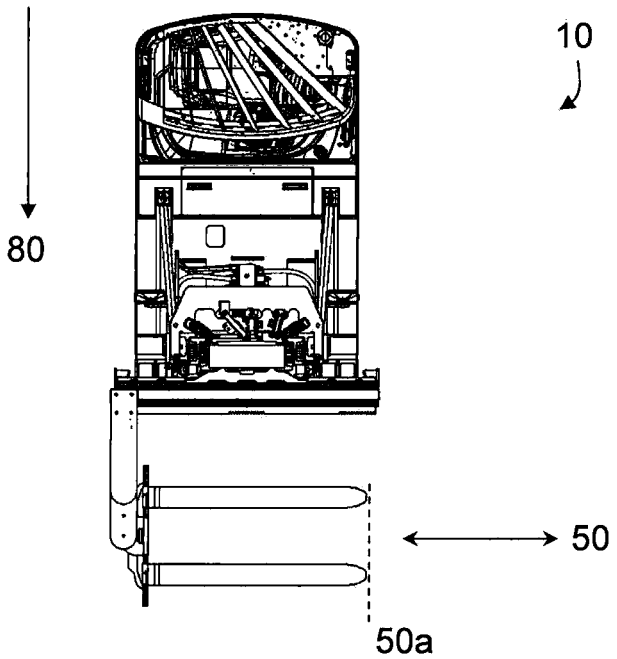
FIGS. 2 & 3 show the industrial lift truck of FIG. 1 from above.
Figure 3:
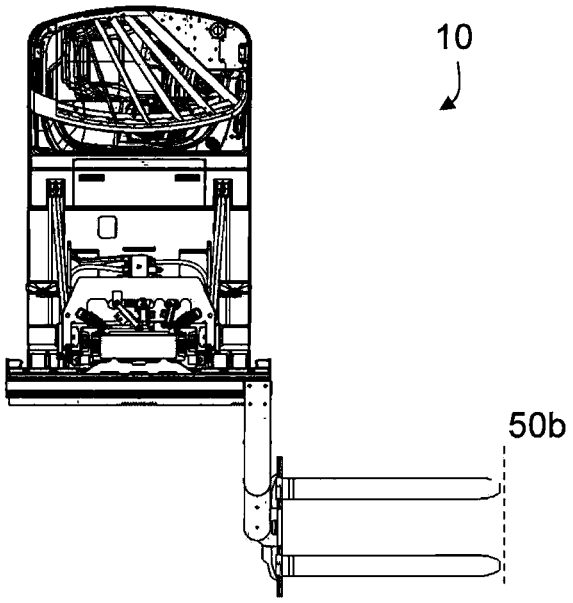

The invention will first be described with reference to a narrow aisle forklift truck 10 disclosed in FIGS. 1-3. Such a truck 10 comprises a truck body 20 with a motor, a plurality of wheels, a vertically extendable lift mast, a truck computer 90 (not shown in detail) and an operator's compartment. Attached to the lift mast is a load supporting member in the form of a bracket 70 carrying two lift forks 30. The lift forks 30 extend in a horizontal direction 50 which is perpendicular to the longitudinal direction 80 of the truck body 20.

The bracket 70 with the lift forks 30, hereinafter jointly referred to as forks 30, are movable in a vertical direction 40 and in a horizontal direction 50 in relation to the truck body 20. In this connection, the vertical direction 40 can be referred to as a lift direction 40 and the horizontal direction 50 can be referred to as a traverse direction 50. FIGS. 1 and 2 show the lift forks 30 when in their innermost horizontal position 50*a*, and FIG. 3 shows the lift forks 30 when in their outermost horizontal position 50*b*. Movement in the horizontal direction 50 equals movement in a plane that is parallel to a plane through the base of the truck body 20 only. Movement in the vertical direction 40 equals movement in a plane that is perpendicular to said plane through the base of the truck body 20 only.

Typically, the narrow aisle forklift truck 10 operates in aisles formed between pallet shelves in a warehouse. Pallets are transported on the forks 30. An operator drives the narrow aisle forklift truck 10 from the operator's compartment, and raises the lift forks 30 in the lift direction 40 to a desired shelf height where a pallet is to be placed. At this stage, the lift forks 30 are in their innermost horizontal position 50*a*. Next, the lift forks 30 are moved in the traverse direction 50, away from their innermost position 50*a* to their outermost position 50*b*, transferring the pallet to an extended location above its dedicated position in the shelf. Now, the forks 30 carrying the pallet are lowered, leaving the pallet 30 at its dedicated position. Subsequently the forks 30 are retracted back to their innermost horizontal position 50*a*, disengaging the pallet tunnels, and again lowered in the lift direction 40.

From a dynamical stability point of view, a crucial moment in the procedure described is the lowering of the forks 30 in a traverse position. The same applies when the forks 30 are lifted in order to pick up a pallet in a shelf. When the narrow aisle forklift truck 10 operates in aisles, such a traversed position of the forks 30 corresponds to the forks 30 being in their outermost horizontal position 50*b*, as is illustrated in FIG. 3. The inertia affecting the truck 10 structure and arising from the acceleration of the forks 30 and the palled load is magnified by the lever caused by the fact that the forks 30 are at a traverse position. When the forks 30 are at such positions, the narrow aisle forklift truck 10 may tend to tilt sideways, i.e. around the longitudinal direction 80. According to the invention, this effect is reduced by limiting the maximum allowed acceleration of the lowering or lifting of the forks 30 when in traversed positions. Additionally, the maximum allowed speed of the lowering or lifting of the forks 30 may be reduced.

Lowering and lifting the forks 30 when they are in their outermost horizontal position 50*b* is normally made for putting down or lifting up a pallet on a pallet shelf. When the forks 30 are in intermediate horizontal positions, i.e. between the innermost 50*a* and the outermost 50*b* positions, lifting and lowering is normally made for fine adjustment of the forks 30 in connection with a pallet being engaged. Thus, in situations where the forks 30 are away from the innermost horizontal position 50*a*, there is generally no need for high vertical acceleration or speed. A limitation of the maximum allowed vertical acceleration and/or speed in fact facilitates the operator's work. The operator is then allowed to operate the truck controls with less caution and accuracy. A suitable vertical speed reduction is approximately 70-80%.

According to the invention, the vertical acceleration and/or speed is only limited when the forks 30 are at specific horizontal positions in relation to the truck body 20. In the example described here, this means that the vertical acceleration and/or speed is not limited when the forks 30 are in their innermost horizontal position 50*a*. During normal operation of the narrow aisle forklift truck, the forks 30 are most often positioned at their innermost horizontal position 50*a*. Traverse positions, i.e. positions away from the innermost position 50*a*, are only used when a pallet is to be engaged or put down. Thus, most of the time, the reduced allowed vertical acceleration and/or speed does not have any influence on the operator's work.

According to a simple realization of the present invention, the narrow aisle forklift truck 10 is furnished with a mechanical switch in form of a spring-back push-button switch 60 (not shown in detail) that is arranged on the truck body 20. When the forks 30, or the bracket 70 to be precise, are located in their innermost horizontal position 50*a*, the bracket 70 lies against the push-button switch 60. As soon as the bracket 70 leaves its innermost position 50*a*, the push-button switch 60 is triggered and the vertical acceleration and/or speed of the forks 30 is limited. However, the narrow aisle forklift truck 10 may alternatively comprise more complex means for sensing the horizontal position of the forks 30.

The narrow aisle forklift truck 10 may comprise locating means (not shown) for determining when the truck 10 is located within an aisle. Different operation conditions, regarding e.g. truck travel speed and load handling, may apply depending on whether the narrow aisle forklift truck 10 is located within an aisle or not. Such locating means may comprise photocells or magnetic sensors, arranged to cooperate with isle markings in a warehouse, and are connected to the truck computer 90. Thereby, the reduction of the maximum allowed acceleration and/or speed of the load supporting member 30 may be activated only when the narrow aisle forklift truck 10 is located within an aisle.

Figure 4:
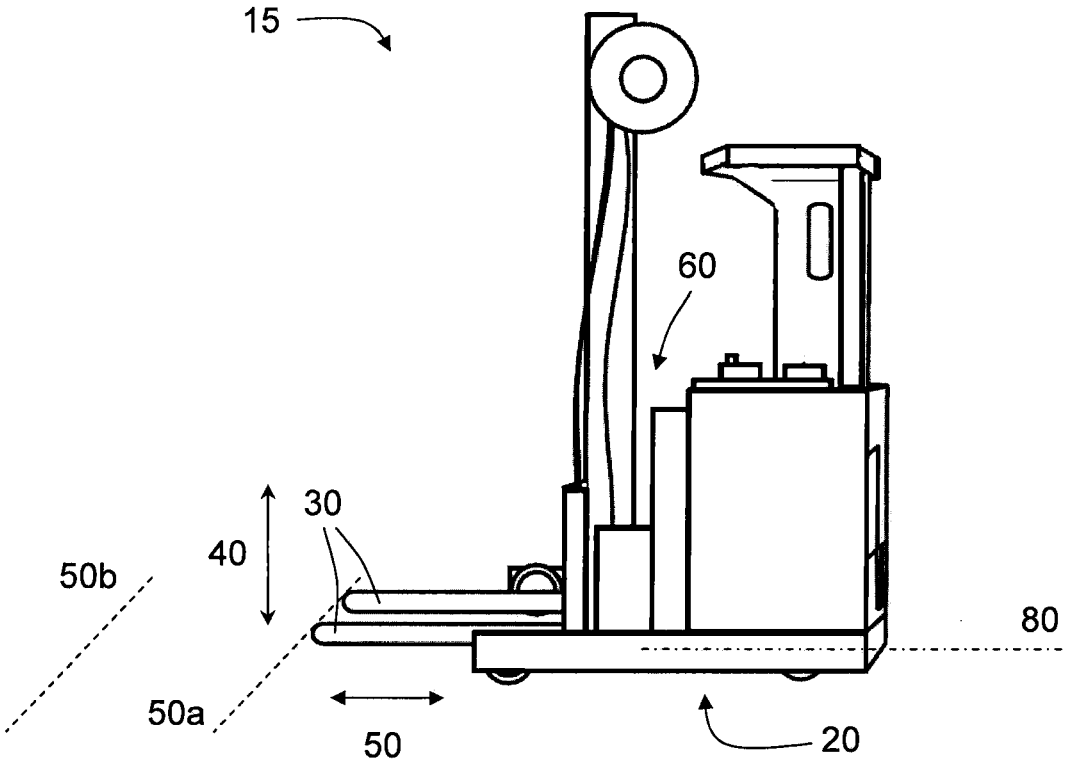
FIG. 4 shows an industrial lift truck in the form of a reach truck.

The invention will now be described with reference to a reach truck 15 as disclosed in FIG. 4. Generally, when compared to a narrow aisle forklift truck 10, where lift forks 30 extend in a horizontal direction 50 which is perpendicular to the longitudinal direction 80 of the truck body 20, the lift forks 30 of a reach truck 15 extend in a horizontal direction 50 which is parallel to the longitudinal direction 80 of the truck body 20.

As has been described with reference to the narrow aisle forklift truck 10, the forks 30 of the reach truck 15 are movable in a vertical direction 40 and in a horizontal direction 50 in relation to the truck body 20. In this case, the vertical direction 40 is the lift direction 40 whereas the horizontal direction 50 is the longitudinal direction 80 of the truck body 20. Actually, when the forks 30 are moved in the horizontal direction 50 in relation to the truck body 20, not only the forks 30 but also the mast carrying the forks 30 is moved in the horizontal direction 50. The mast and the forks 30 are hereinafter jointly referred to as forks 30.

The reach truck 15 typically handles pallets. The forks 30 can be moved in the horizontal direction 50 in relation to the truck body 20 e.g. when a pallet is to be picked up or placed. FIG. 4 illustrates the reach truck 15 with the forks 30 in their innermost horizontal position 50*a*, and the outermost horizontal position 50*b* is illustrated schematically.

It is to be apprehended that the further the forks 30 are extended from their innermost horizontal position 50*a*, the larger is the lever of the forks 30 and the pallet carried thereby. When the forks 30 are extended from their innermost horizontal position 50*a*, the reach truck 15 may tend to tilt forwards, i.e. in the longitudinal direction 80. According to the invention, this effect is reduced by limiting the maximum allowed acceleration of the lowering or lifting of the forks 30 when in extended positions. Additionally, the maximum allowed speed of the lowering or lifting of the forks 30 may be reduced.

The reach truck 15 may be furnished with a mechanical switch in form of a spring-back push-button switch 60 (not shown in detail) that is arranged on the truck body 20. When the forks 30, or the lift mast to be precise, are located in their innermost horizontal position 50*a*, the lift mast lies against the push-button switch 60. As soon as the lift mast leaves its innermost position 50*a*, the push-button switch 60 is triggered and the vertical acceleration and/or speed of the forks 30 is limited.

The reach truck 15 may alternatively be furnished with contact-free position sensing means 60 for sensing the horizontal position of the forks 30. Examples of contact-free proximity sensor means 60 include inductive, magnetic, capacitive, ultrasonic and laser sensors.

When position sensing means 60 that are capable of detecting the current position of the forks 30 all along the way between the innermost horizontal position 50*a* and the outermost horizontal position 50*b*, the maximum allowed vertical acceleration and/or speed of the forks 30 may be limited in several steps dependent on the current horizontal position of the forks 30. The maximum allowed vertical acceleration and/or speed of the forks 30 may also be regulated in a stepless manner. The maximum allowed vertical acceleration and/or speed of the forks 30 may be reduced gradually from the innermost position 50*a* to the outermost position 50*b*. A detailed example being maximum allowed vertical speed of the forks 30 when in the innermost position 50*a* being 100%, and maximum allowed vertical speed of the forks 30 when in the outermost position 50*b* being 30%. The described contact-free position sensing means 60, and the gradual reduction of the maximum allowed acceleration and/or speed can also be applied on the narrow aisle forklift truck 10.

The horizontal position of the forks 30 can also be registered by means of a position sensing means 60 in form of a sensor-bearing (not shown) arranged in the mechanism conducting the horizontal movement of the forks 30. The sensor-bearing is connected to the truck computer 90 which keeps track on the number of bearing revolutions and based thereon calculates the position of the forks 30.

Figure 5:
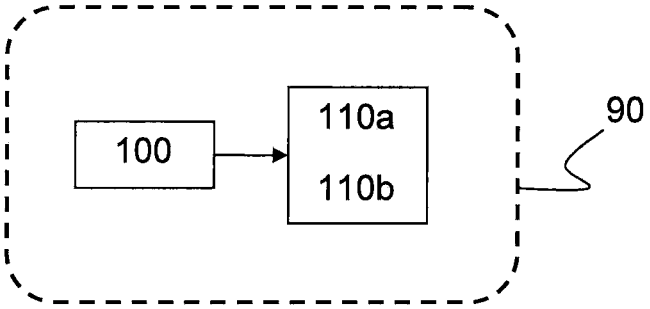
FIG. 5 is a flow chart illustrating a method for controlling an industrial lift truck.

A method for controlling an industrial lift truck e.g. of the kinds described above will now be explained with reference to FIG. 5. The method is carried out by the truck computer 90 (as is symbolically indicated by the dashed line in FIG. 5) which is connected to the position sensing means 60 and comprises a processor and a memory in which a computer program is stored. The computer program comprises computer readable code, which, when run in the processor, is disposed to control the truck 10, 15 in accordance with the method.

In a first step 100, the horizontal position of the forks 30 is sensed. This can be realized by means of a position sensing means 60, such as a push-button switch or a contact-free proximity sensor, or by means of a sensor-bearing.

In a second step 110*a*, the maximum allowed vertical acceleration of the forks 30 is reduced. At the same time, the maximum vertical allowed speed of the forks 30 may be reduced 110*b*.

If the acceleration and/or speed is to be reduced in a stepless manner depending on the specific position of the forks 30, a further step of comparing the horizontal position of the forks 30 with one or more reference positions may be implemented. This is carried out by the computer 90, which then reduces the acceleration and/or speed accordingly.

The invention claimed is:

1. A narrow aisle forklift truck comprising:

a truck body;

a load supporting member, wherein the load supporting member is movable in a vertical direction and in a horizontal direction in relation to the truck body, wherein said forklift truck is adapted to reduce the maximum allowed acceleration of the load supporting member in the vertical direction when the load supporting member is located at specific horizontal positions in relation to the truck body; and a sensor determining if the narrow aisle forklift truck is located within an aisle, wherein said narrow aisle forklift truck is adapted to reduce the maximum allowed acceleration of the load supporting member only when the narrow aisle forklift truck is located within an aisle.

2. The industrial truck of claim 1, wherein the load supporting member is movable between an innermost horizontal position and an outermost horizontal position, and wherein the truck is adapted to reduce the maximum allowed acceleration of the load supporting member in the vertical direction when the load supporting member is located a distance away from said innermost horizontal position.

3. The industrial truck of claim 2, comprising a sensor sensing the horizontal position of the load supporting member in relation to the truck body.

4. The industrial truck of claim 3, wherein the sensor is triggered when the load supporting member is located at the innermost horizontal position.

5. The industrial truck of claim 1, wherein the load supporting member is movable in said horizontal direction, said horizontal direction being perpendicular to the longitudinal direction of the truck body.

6. The industrial truck of claim 1, wherein the load supporting member is movable in said horizontal direction, said horizontal direction being parallel to a longitudinal direction of the truck body.

7. The industrial truck of claim 3, comprising an on-board truck computer with a memory and a processor, said computer controlling movement of the load supporting member in the vertical direction and in the horizontal direction in relation to the truck body, wherein said computer is connected to the sensor and is adapted to reduce the maximum allowed acceleration of the load supporting member in the vertical direction when the load supporting member is located at specific horizontal positions in relation to the truck body.

8. The industrial truck of claim 1, said industrial truck being a narrow aisle forklift truck.

9. The industrial truck of claim 1, said industrial truck being a reach truck.

10. The industrial truck of claim 1, wherein the truck is adapted to also reduce the maximum allowed speed of the load supporting member in the vertical direction when the load supporting member is located at specific horizontal positions in relation to the truck body.

11. A method for controlling the industrial truck of claim 1, said method comprising the step of:

reducing the maximum allowed acceleration of the load supporting member of the industrial truck of claim 1 in the vertical direction when the load supporting member is located at the specific horizontal positions iii relation to the truck body.

12. The method of claim 11, further comprising the step of sensing the horizontal position of the load supporting member in relation to the truck body.

13. The method of claim 11, further comprising the step of reducing the maximum allowed speed of the load supporting member in the vertical direction when the load supporting member is located at specific horizontal positions in relation to the truck body.

14. The method of claim 11, including executing said step using a processor of the industrial truck.

* * * * *